US005205344A

United States Patent [19]

Nagai et al.

[11] Patent Number: 5,205,344

[45] Date of Patent: Apr. 27, 1993

[54] HORIZONTAL CONTINUOUS CASTING DEVICE

[75] Inventors: Yoshitaka Nagai; Makoto Arase; Norio Ohatake, all of Toyama, Japan

[73] Assignee: Yoshida Kogyo K. K., Tokyo, Japan

[21] Appl. No.: 521,421

[22] Filed: May 10, 1990

[30] Foreign Application Priority Data

May 11, 1989 [JP] Japan ..... 1-116023

[51] Int. Cl.[5] ..... B22D 11/08

[52] U.S. Cl. ..... 164/440; 164/490; 164/472

[58] Field of Search ..... 164/440, 490, 268, 472

[56] References Cited

U.S. PATENT DOCUMENTS 3,329,200 7/1967 Craig ..... 164/268
4,688,624 8/1987 Suzuki et al. ..... 164/440

FOREIGN PATENT DOCUMENTS 761483 7/1971 Belgium ..... 164/440
53-138926 12/1978 Japan ..... 164/472
61-154736 7/1986 Japan ..... 164/440
1348057 10/1987 U.S.S.R. ..... 164/472

*Primary Examiner*—Kuang Y. Lin
*Attorney, Agent, or Firm*—Hill, Steadman & Simpson

[57] ABSTRACT

A horizontal continuous casting device including a mold horizontally mounted through an orifice plate on a front side of a tundish. A front portion of the orifice plate is exposed into the mold. A horizontally extending small gap is formed between an outer circumferential surface of the front portion of the orifice plate and an inner circumferential surface of the mold. A facing surface between the mold and the orifice plate is provided with an annular lubricating oil passage and a given number of radial grooves communicated from the lubricating oil passage to the gap.

1 Claim, 3 Drawing Sheets

HORIZONTAL CONTINUOUS CASTING DEVICE

BACKGROUND OF THE INVENTION

1. Field of the Invention

The present invention relates to a horizontal continuous casting device which improves a manner of lubrication of a cast ingot and can carry out stable casting.

2. Description of Prior Art

A known horizontal continuous casting device designed to improve a manner of lubrication of a cast ingot is disclosed in Japanese Patent Publication No. 40-19572, for example. In this prior art device, a mold is provided with an annular lubricating oil passage and a plurality of radial grooves communicated from the lubricating oil passage to an inner circumferential surface of the mold. A lubricating oil is supplied from the lubricating oil passage through the radial grooves to an outer circumferential surface of the cast ingot, thus effecting lubrication of the cast ingot.

In the above prior art, the radial grooves are formed as very small grooves so that a molten metal may not be forced into the grooves in a cast starting operation. However, as the grooves are actually so formed as to extend in a direction substantially perpendicular to the outer surface of the cast ingot, there is a possibility that the molten metal will be forced into the grooves by its pressure and solidified in the grooves in the cast starting operation. As a result, there is generated a surface defect of the cast ingot such as roughness of a casting surface and burning due to lack of lubrication. Even when the molten metal is not forced into the radial grooves, the lubricating oil is fed from the radial grooves directly to the outer circumferential surface of the cast ingot, causing a problem such that the lubricating oil is attached in lines on the outer surface of the cast ingot, and is not uniformly expanded over the outer surface of the cast ingot. As a result, there is a possibility that a surface defect such as burning of the surface of the cast ingot will be generated.

SUMMARY OF THE INVENTION

It is an object of the present invention to provide a horizontal continuous casting device which eliminates the possibility of formation of the surface defect of the cast ingot.

According to the present invention, there is provided in a horizontal continuous casting device including a mold horizontally mounted through an orifice plate on a front side of a tundish; the improvement wherein a front portion of the orifice plate is exposed into the mold, and a horizontally extending small gap is formed between an outer circumferential surface of the front portion of the orifice plate and an inner circumferential surface of the mold, and a facing surface between the mold and the orifice plate is provided with an annular lubricating oil passage and a given number of radial grooves communicated from the lubricating oil passage to the gap.

It is preferable that the orifice plate is replaceably held between a heat insulating wall of the tundish and the mold. The front portion of the orifice plate is inserted into the mold by a predetermined length, so that the horizontally extending small gap is defined between the outer circumferential surface of the front portion of the orifice plate and the inner circumferential surface of the mold. While the orifice plate may have a flat front surface, a recess is preferably formed on the front surface of the orifice plate in a range surrounding outlets of orifices of the orifice plate.

The lubricating oil is supplied from the annular lubricating oil passage provided on the facing surface between the mold and the orifice plate through the radial grooves into the horizontally extending small gap defined between the outer circumferential surface of the front portion of the orifice plate and the inner circumferential surface of the mold. Then, the lubricating oil is expanded over the gap, and is uniformly fed to the outer surface of the cast ingot. In this manner, the lubricating oil is uniformly fed to the entire outer surface of the cast ingot, and it is allowed to flow in the same direction as a drawing direction of the cast ingot, thereby ensuring stable casting.

According to the present invention, the lubricating oil flowing from the annular lubricating oil passage formed at the contacting portion between the mold and the orifice plate through the radial grooves first reaches the outer circumferential surface of the front portion of the orifice plate, and then a flowing direction of the lubricating oil is changed into a direction parallel to the drawing direction of the cast ingot. The lubricating oil is substantially uniformly expanded over the horizontal small gap defined between the inner circumferential surface of the mold and the outer circumferential surface of the orifice plate, and is then fed to the outer surface of the cast ingot. Accordingly, the outer surface of the cast ingot can be substantially uniformly lubricated, and a surface defect of the cast ingot is therefore hard to generate. Furthermore, since the lubricating oil is allowed to flow in the horizontal gap extending in parallel to the drawing direction of the cast ingot, and is fed to the outer surface of the cast ingot, the possibility of the molten metal being forced into the gap under pressure at starting of the casting operation is less than that in the prior art. Accordingly, there is hardly generated a surface defect of the cast ingot to be caused by solidification of the molten metal in the passage of the lubricating oil.

Further, in the case that the recess is formed on the front surface of the orifice plate, and the rear end surface of the starting block is disposed to abut against the front surface of the orifice plate, the molten metal is quite prevented from contacting the outlet of the lubricating oil. Accordingly, the possibility of the molten metal being forced into the gap at starting of the casting operation is eliminated more reliably, and the surface defect of the cast ingot is harder to generated.

Other objects and features of the invention will be more fully understood from the following detailed description and appended claims when taken with the accompanying drawings.

DETAILED DESCRIPTION OF THE PREFERRED EMBODIMENTS

Figure 1:
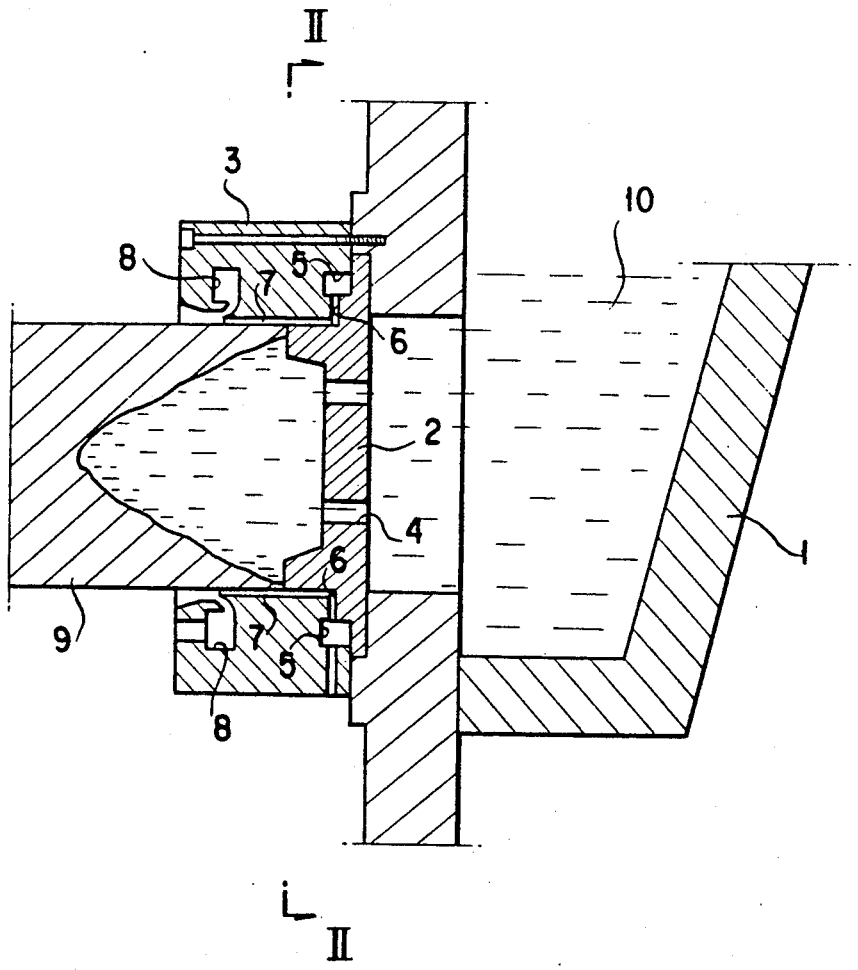
FIG. 1 is a sectional view of the first preferred embodiment of the present invention.
Figure 2:
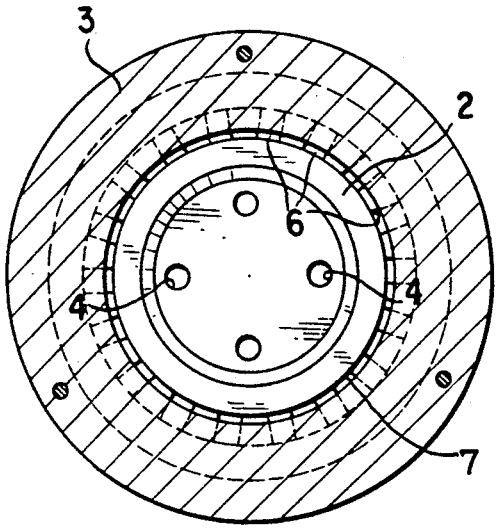
FIG. 2 is a cross section taken along the line II-II in FIG. 1.
Figure 3:
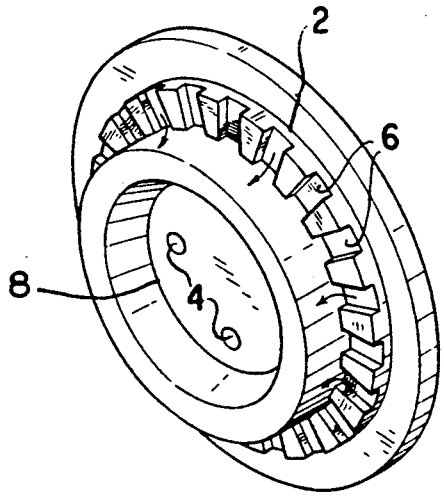
FIG. 3 is a perspective view of the orifice plate.

FIG. 1 is a sectional view of a preferred embodiment of the horizontal continuous casting device according to the present invention; FIG. 2 is a cross section taken along the line II—II in FIG. 1; and FIG. 3 is a perspective view of the orifice plate. Referring to these drawings, reference numerals 1, 2 and 3 designate a tundish, an orifice plate and a mold, respectively. The orifice plate 2 is formed with a plurality of (four in this embodiment) orifices 4. An annular lubricating oil passage 5 is formed in the mold 3 on a facing surface between the orifice plate 2 and the mold 3, and a given number of radial grooves 6 are formed on the orifice plate 2. An annular small gap 7 extending horizontally is defined between an outer circumferential surface of a front portion of the orifice plate 2 and an inner circumferential surface of the mold 3. The annular gap 7 is communicated with the radial grooves 6. A cooling water passage 8 is formed in the mold 3 to inject a cooling water and cool a cast ingot 9. A molten metal 10 in the tundish 1 is induced through the orifices 4 into a space inside the mold 3, and is cooled to form the cast ingot 9.

Figure 4:
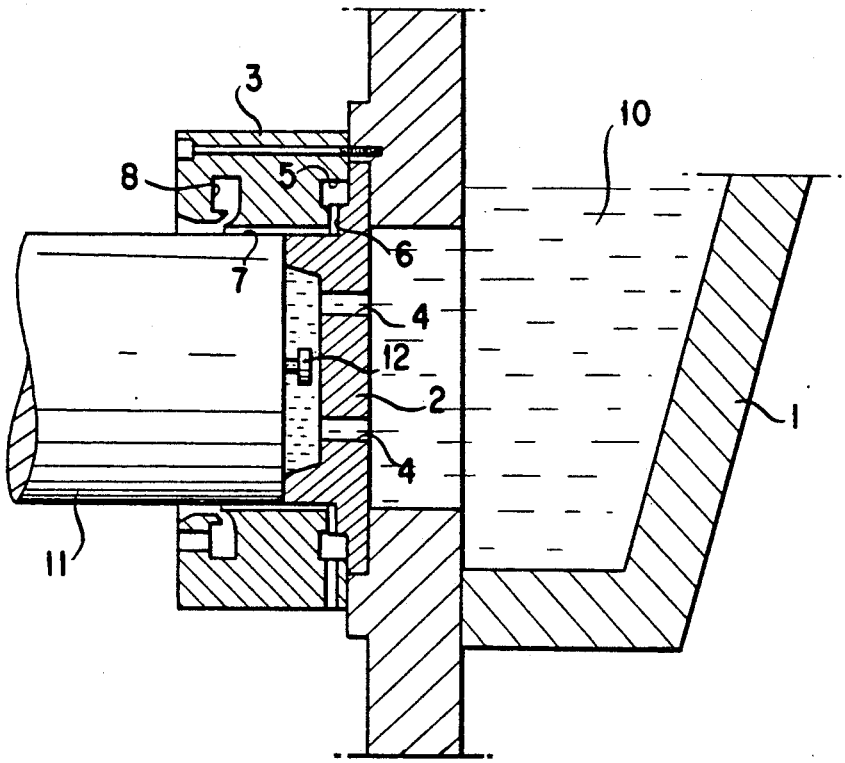
FIG. 4 is an illustration of the cast starting operation according to the first preferred embodiment.

Referring to FIG. 4 which shows a cast starting operation, a starting block 11 is inserted into the inside space of the mold 3 until a rear end surface of the starting block 11 comes into abutment against a front surface of the orifice plate 2. The orifice plate 2 is formed on its front surface with a recess, and a starting pin 12 is located in the recess at a position not aligned to outlets of the orifices 4. Under the condition, the molten metal 10 is let flow from the tundish 1 through the orifice 4 into a closed space formed by the recess. At the same time, a lubricating oil is supplied from the lubricating oil passage 5 through the radial grooves 6 and the annular gap 7 to the inner circumferential surface of the mold 3, and flows on an outer circumferential surface of the starting block 11. Accordingly, the molten metal 10 does not directly contact the annular gap 7 as an outlet of the lubricating oil at starting of the casting operation. Therefore, there occurs no trouble such that the molten metal 10 is formed into the annular gap 7 and is solidified therein.

Figure 5:
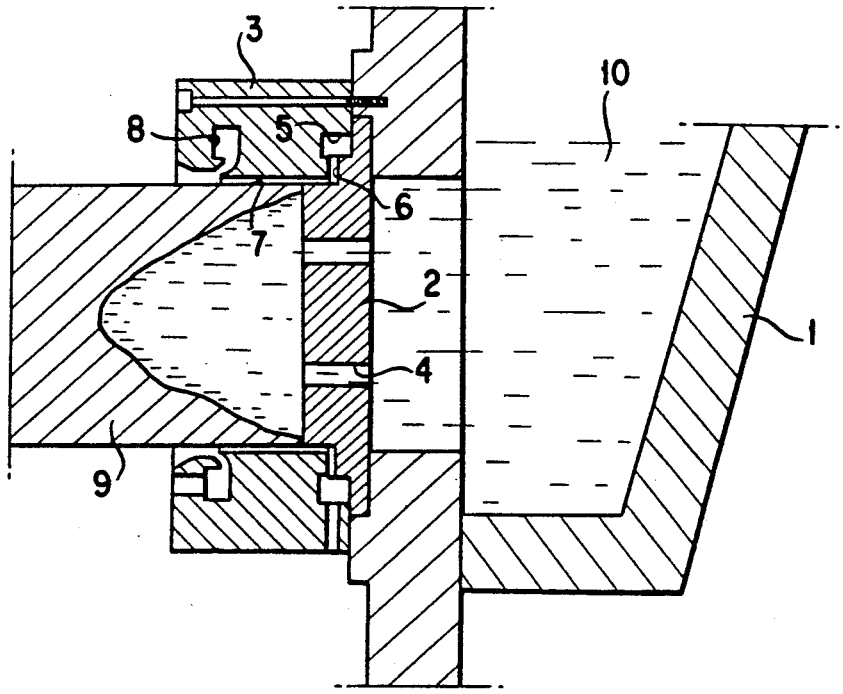
FIG. 5 is a sectional view of the second preferred embodiment according to the present invention.

FIG. 5 shows another preferred embodiment of the present invention. In this embodiment, the front surface of the orifice plate 2 is not formed with the recess as mentioned in the previous preferred embodiment. However, as the lubricating oil is allowed to flow out through the horizontal annular gap 7 in the same direction as the drawing direction of the solidified molten metal 10, there is no possibility that the molten metal 10 will flow reversely to be forced into the annular gap 7 and solidified therein.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a horizontal continuous casting device including a mold horizontally mounted with an orifice plate on a front side of a tundish; the improvement wherein a front portion of said orifice plate is exposed into said mold, and a horizontally extending small gap is formed between an outer circumferential surface of said front portion of said orifice plate and an inner circumferential surface of said mold, and a facing surface between said mold and said orifice plate is provided with an annular lubricating oil passage and a plurality of radial grooves which communicate from said lubricating oil passage to said gap.

* * * * *